United States Patent [19]

Faul et al.

[11] 4,142,949

[45] * Mar. 6, 1979

[54] PROCESS FOR PRODUCING AN ELECTRODE FOR USE IN THE ELECTROLYTIC GENERATION OF HYDROGEN PEROXIDE

[75] Inventors: Wolfgang Faul, Jülich; Bertel Kastening, Hamburg, both of Fed. Rep. of Germany

[73] Assignee: Kernforschungsanlage Jülich GmbH, Jülich, Fed. Rep. of Germany

[ * ] Notice: The portion of the term of this patent subsequent to Jul. 6, 1993, has been disclaimed.

[21] Appl. No.: 769,190

[22] Filed: Feb. 16, 1977

[30] Foreign Application Priority Data

Feb. 25, 1976 [DE] Fed. Rep. of Germany ..... 2607510

[51] Int. Cl.[2] ..... C25B 1/30

[52] U.S. Cl. ..... 204/84; 204/294; 423/449; 423/460; 423/461; 427/120; 427/122

[58] Field of Search ..... 204/84, 294; 423/449, 423/460, 461; 427/120, 122

[56] References Cited

U.S. PATENT DOCUMENTS

| | | | |
|---|---|---|---|
| 1,646,389 | 10/1927 | Bunting | 423/449 |
| 1,722,055 | 7/1929 | Lowry | 423/461 |
| 3,111,396 | 11/1963 | Ball | 423/449 |
| 3,856,574 | 12/1974 | Amagi et al. | 204/294 |
| 3,856,640 | 12/1974 | Halfar et al. | 204/294 |
| 3,968,273 | 7/1976 | Kastening et al. | 204/84 |

*Primary Examiner*—T. Tung

*Attorney, Agent, or Firm*—Karl F. Ross

[57] ABSTRACT

An electrode especially adapted for the electrolytic production of hydrogen peroxide is made by heating activated carbon powder to a temperature above 900° C. and mixing it with a binder and a hydrophobic additive, an electrically conductive network being embedded in the mixture. According to the invention, the activated carbon is heated to incandescence in a hydrogen atmosphere.

10 Claims, 10 Drawing Figures

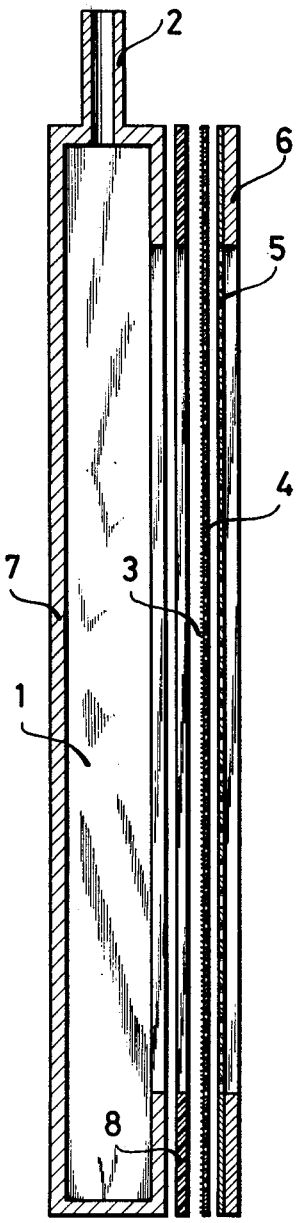
2
6
5
4
7
3
1
8

PROCESS FOR PRODUCING AN ELECTRODE FOR USE IN THE ELECTROLYTIC GENERATION OF HYDROGEN PEROXIDE

FIELD OF THE INVENTION

The present invention relates to a process for producing an electrode adapted to be employed in the electrolytic production of hydrogen peroxide, to a hydrogen peroxide-generating electrode made by the improved process, and to a process for the electrolytic generation of hydrogen peroxide using an electrode made by this process.

BACKGROUND OF THE INVENTION

The production of hydrogen peroxide by cathodic reduction of oxygen in an aqueous electrolyte is known as is the use of special electrodes, electrode materials and electrode compositions as the cathode in such processes for the production of hydrogen peroxide. In general, the oxygen required for reduction is introduced into contact with the aqueous phase, i.e. the electrolyte, through the permeable electrode which can have, as the active electrode material, an activated carbon in which a conductive network, e.g. a grid, is embedded. Furthermore, to prevent complete wetting of the active material and saturation of the interstices thereof with the electrolyte, the active mass may include a hydrophobic material such as polytetrafluoroethylene.

The reaction is deemed to occur at the three-phase interface formed by the gas, the aqueous electrolyte and the solid material of the electrode. The cathodic current is supplied by the conductive grid which is embedded in the active mass.

It is known from German open application (Offenlegungsschrift) 23 53 259 and U.S. Pat. No. 3,968,273 to produce electrodes of this type, especially for use in the electrolytic production of hydrogen peroxide, by heating activated-carbon powder in a vacuum to incandescence at temperatures above 900° C. This process is thought to create a surface structure of the activated carbon which promotes the generation of the hydrogen peroxide. Possible impurities on the active surface of the active carbon are eliminated by physical desorption in the vacuum used during the incandescent heating.

This process has, however, the disadvantage that long incandescent heating times are required to obtain the optimum surface structure and characteristics necessary for effective production of the hydrogen peroxide. Naturally, since the reaction vessel must remain under high vacuum during these prolonged periods, the construction thereof must take this fact into consideration. As a result, the vessel is placed under high stresses and frequently must be inspected, repaired and maintained, or must be constructed and dimensioned, at high cost, to avoid such maintenance and operating expenditures. As a practical matter, the high vacuum cannot be maintained for such long periods in a reasonable and effective manner.

OBJECTS OF THE INVENTION

It is the principal object of the present invention to provide an improved process for the production of an electrode adapted to be used for the electrolytic formation of hydrogen peroxide whereby the aforedescribed disadvantages are obviated.

It is another object of this invention to provide an improved method of making the active mass of such an electrode such that relatively low-cost vessels can be used or the fabrication costs can be diminished by comparison with earlier systems.

Yet another object of the invention is to provide an improved process for producing an electrode of the type described which is characterized by high current density and high current-conversion efficiency (hydrogen peroxide produced per unit of current flow), long life and low cost.

It is also an object of this invention to provide an improved electrode for the production of hydrogen peroxide by cathodic electrolysis of an aqueous solution in the presence of oxygen and an improved process for the production of hydrogen peroxide.

SUMMARY OF THE INVENTION

These objects and others which will become apparent hereinafter are attained in accordance with the present invention which is based upon our most surprising discovery that it is not necessary to treat the active carbon under vacuum for long periods of time to achieve the desired elimination of impurities and the appropriate surface structure for optimum hydrogen peroxide formation. According to the invention, the active carbon powder is both heated to incandescence and cooled in a hydrogen atmosphere. Thereafter, the active carbon powder, so-treated in the hydrogen atmosphere, is mixed with a solvent containing the binder and the hydrophobic additive. The resulting mixture, generally in the form of a paste or slurry, is then applied to the electrically conductive support and dried thereon.

We have found that the use of hydrogen as the atmosphere for the incandescent heating of the active-carbon powder provides the chemically reducing environment necessary for producing a surface structure having unique characteristics in the production of hydrogen peroxide during use of the electrode containing the active-carbon powder as the active mass in the production of hydrogen peroxide. Still more surprisingly, the incandescent heating of the active-carbon powder in a hydrogen atmosphere reduced significantly the treatment time required to generate the surface structure which is necessary for effective hydrogen peroxide generation by comparison with known incandescent heating processes which take place in a vacuum.

We have found, moreover, that it is also important to cool the active carbon powder in the hydrogen atmosphere. Failure to do so appears to eliminate part of the surface structure which imparts to the product the desired characteristics for the generation of hydrogen peroxide by electrolytic techniques.

Advantageously, the hydrogen-treated active-carbon powder is mixed with the binder and hydrophobic additive at room temperature, thereby eliminating any need for a heat treatment such as a sintering which has frequently been required heretofore. Since the mixture can be formed with a solvent which is readily vaporizable, application of the mixture to the electrically conductive carrier, support or grid is greatly facilitated.

According to another feature of the invention, the incandescent heating of the active carbon is carried out with a hydrogen gas stream which is passed through the active-carbon powder, any reaction products being removed from the active carbon powder by being entrained in the throughgoing hydrogen gas stream. This appears to accelerate the reaction. The reaction vessel may be held at substantially atmospheric pressure so that the walls of this vessel are under substantially reduced stress by comparison with systems operating under a vacuum.

We have found it to be desirable to heat the active-carbon powder at incandescency for at least 30 minutes and for the most five hours. Such an incandescent-heating time has been found to yield the best results in terms of the surface structure of the active-carbon powder. Incandescent heating is best carried out at a temperature of 1000° C. to 1250° C. (inclusive) in a reaction vessel to which the gas is admitted at a rate corresponding to a full change of the atmosphere (hydrogen) between 2 and 7 times (inclusive) per hour. A preferred treatment time is between 1 and 2 hours. When these parameters are observed in the process for forming the active mass for the electrode, the current density, which can be used during the subsequent electrolysis as well as the operating life of the electrode, can be increased sharply with undiminished activity.

For uniform distribution of the active-carbon powder in the mass to be applied to the conductive carrier or support and for a homogeneous mixture of the active-carbon powder with the binder and hydrophobic additive, it is desirable to use a starting active-carbon powder with a particle size of less than 40 microns. It is found that, in this case, classification subsequent to incandescent heating, e.g. by sifting, is not necessary and a layer of excellent porosity can be formed on the conductive support or carrier.

The application of the mixture to the support or carrier is facilitated when the mixture consists of 2 to 10 grams of the hydrogen-treated active carbon powder and 0.2 to 1 gram of the binder and 0.5 to 5 grams of the hydrophobic material per 100 ml of solvent. While any conventional binder and hydrophobic material of the types previously used for such electrodes can be employed here, we prefer to use a rubber binder and PTFE powder as hydrophobic material. The solvent should, of course, be an organic compound in which the binder is soluble and the hydrophobic material can be solved or suspended therein. An effective composition can be formed by mixing 0.2 to 1 gram of rubber and 2 to 10 grams of the active carbon powder with each 100 ml of such a solvent. A mixture of this type has been found to be highly effective in applying to the surface of the conductive support or carrier a sufficiently fine active carbon layer.

The electrode fabricated from the hydrogen-treated active carbon powder can be introduced into an electrolysis cell containing the electrolyte, supplied with the gas and used to produce hydrogen peroxide in the usual manner. The active carbon-containing gas-permeable membrane is applied to a metal grid covering a gas chamber to which the oxygen is supplied. An intimate contact between the metal grid and the coated electrically conductive support or carrier can thus be achieved over practically the entire surface of the opening spanned by the membrane, thereby insuring uniform current distribution over the entire effective electrode surface, even for large-area electrodes.

BRIEF DESCRIPTION OF THE DRAWING

The above and other objects, features and advantages of the invention will be more readily apparent from the accompanying drawing whose sole FIGURE is a vertical cross-sectional view, in exploded form, of a hydrogen-generating electrode according to the invention.

SPECIFIC DESCRIPTION

In the drawing, in which the electrode is seen in exploded and diagrammatic form, we have shown a gas chamber 1 which can be supplied with oxygen or an oxygen-containing gas via a passage 2 opening at one end into this chamber. The chamber is formed by a box-like housing provided with an opening at one face, which is spanned by a layer 3 constituted by a mixture of hydrogen-treated, incandescently heated, active-carbon powder with a binder and hydrophobic additive, applied to a fine-mesh electrically conductive support or carrier 4. The carrier 4 lies against a large-mesh nickel screen 5 which is spanned across the opening of nickel frame 6. The edge region between the support grid 4 and the housing 7 is provided with a gas-tight sealing frame 8 of a synthetic-resin material. The entire assembly can be held together by clamps, screws or other means.

When the electrode of the drawing is immersed in an aqueous electrolyte for producing hydrogen peroxide, oxygen is fed to the chamber 1 and is distributed outwardly to the active carbon mass. The electrode is connected cathodically against an inert anode and the passage of electric current generates hydrogen peroxide in the electrolyte, the hydrogen peroxide being recovered in any conventional way.

SPECIFIC EXAMPLE 50 g milled (ground) active-carbon powder with a particle size less than 40 microns is placed in a quartz reaction vessel having an internal volume of 300 $cm^3$. Through the reaction vessel and the mass of active-carbon powder therein, pure hydrogen is passed at a rate of about 1 liter per hour, corresponding to a change in the atmosphere in the vessel of about 3.3 times per hour.

The reaction vessel is heated to an incandescent temperature of 1100° C. after all of the air has been displaced from the vessel by the hydrogen, the incandescent heating is continued for one hour. Hydrogen at room temperature continues to be passed through the vessel after the heating is terminated to cool the active carbon mass.

10 g of natural rubber is dissolved in a mixture of 200 ml of toluene and 200 ml of xylene. 20 ml of this solution is further diluted with 30 ml of toluene and 30 ml of xylene.

1 g of the incandescently heated hydrogen-treated active carbon powder, after cooling in hydrogen, is mixed with each 20 ml of the last-mentioned solution together with 0.3 g of polytetrafluoroethylene in powdered form with a particle size of less than 40 microns. The mixture is a paste which can be applied to a support grid by doctoring.

The support grid is a circular nickel mesh of nickel wire of a diameter of 0.1 mm and a mesh size of 0.16 mm, and has an area of 50 $cm^2$ onto which the paste is doctored. The nickel mesh can be replaced by a stainless steel screen as well. The paste mixture is dried at ambient temperature in the atmosphere and the resulting electrode is found to have 10 mg of active carbon per $cm^2$ of applied area.

The electrode is assembled as shown in the drawing and is placed in an electrolysis cell serving as the cathode against a sheet-nickel anode. The electrolyte is 4 Normal potassium hydroxide solution (aqueous). The potassium hydroxide solution is passed through the cell at a rate of 250 ml per hour, traversing first the anode compartment and then the cathode compartment before entering a separating unit in which the hydrogen peroxide is recovered. From the latter unit the potassium hydroxide solution is returned to the anode compartment.

A current density of 20 amperes/dm$^2$ is applied for a period of 100 hours with the recovery of hydrogen peroxide being 91% based upon the current flow. During operation, the cell voltage against the nickel sheet is 1.8 volts, the temperature of the electrolyte was 25° C. In another test, an electrode with a current density of 20 amperes/dm$^2$ had a cell voltage of 1.6 volts and over an operating period of 48 hours had a hydrogen peroxide yield of 98.5%, based upon the current consumed.

We claim:

1. A process for making an electrode capable of cathodically generating hydrogen peroxide, which comprises the steps of:

incandescently heating an active-carbon powder at a temperature above 900° C. in a hydrogen atmosphere for a period of at least 30 minutes thereby modifying the surface characteristics of the active-carbon powder;

cooling the incandescently heated active-carbon powder in a hydrogen atmosphere;

mixing the cooled active-carbon powder with a binder and a hydrophobic substance to form an active mass; and applying said active mass to a conductive support.

2. The process defined in claim 1 wherein hydrogen is passed through said active-carbon powder during the incandescent heating and during the cooling thereof.

3. The process defined in claim 2 wherein said active-carbon powder is incandescently heated at a temperature between 1000° C. and 1250° C.

4. The process defined in claim 3 wherein said active-carbon powder is incandescently heated in a vessel, the hydrogen atmosphere in said vessel being changed 2 to 7 times per hour during the incandescent heating.

5. The process defined in claim 2 wherein said active-carbon powder is incandescently heated for a period of 1 to 2 hours.

6. The process defined in claim 1 wherein said active-carbon powder has a particle size of less than 40 microns.

7. A method of producing hydrogen peroxide which comprises electrolyzing an aqueous electrolyte with the electrode produced as defined in claim 1 as a cathode while supplying oxygen to said mass.

8. An electrode for the generation of hydrogen peroxide produced as defined in claim 1.

9. The electrode as defined in claim 8 which comprises a housing formed with an opening, said active mass upon said support spanning said opening and forming a diaphragm thereacross.

10. The process defined in claim 1 wherein said mixture is formed in a solvent for said binder.

* * * * *